US006837703B2

(12) United States Patent
Saito

(10) Patent No.: US 6,837,703 B2
(45) Date of Patent: Jan. 4, 2005

(54) IGNITOR

(75) Inventor: Masaki Saito, Shizuoka-ken (JP)

(73) Assignee: Tokai Corporation, Tokyo (JP)

( * ) Notice: Subject to any disclaimer, the term of this patent is extended or adjusted under 35 U.S.C. 154(b) by 0 days.

(21) Appl. No.: 10/476,320

(22) PCT Filed: Oct. 9, 2002

(86) PCT No.: PCT/JP02/10487

§ 371 (c)(1),
(2), (4) Date: Oct. 28, 2003

(87) PCT Pub. No.: WO03/033963

PCT Pub. Date: Apr. 24, 2003

(65) Prior Publication Data

US 2004/0131985 A1 Jul. 8, 2004

(30) Foreign Application Priority Data

Oct. 11, 2001 (JP) ..... 2001-314077

(51) Int. Cl.[7] ..... F23D 11/36
(52) U.S. Cl. ..... 431/153; 431/255
(58) Field of Search ..... 431/153, 255

(56) References Cited

U.S. PATENT DOCUMENTS 5,326,256 A * 7/1994 Shike et al. ..... 431/255
6,135,762 A * 10/2000 Hu ..... 431/153
6,168,423 B1 1/2001 Man
6,386,861 B1 * 5/2002 Sher ..... 431/153
6,443,727 B1 * 9/2002 Huang ..... 431/132
6,666,679 B1 * 12/2003 Ye ..... 431/153

FOREIGN PATENT DOCUMENTS

JP 3078592 * 8/2000

* cited by examiner

*Primary Examiner*—Alfred Basichas
(74) *Attorney, Agent, or Firm*—Baker Botts LLP

(57) ABSTRACT

A construction for an igniter is provided that enables prevention of accidental ignition without the provision of a separate lock member. An igniter includes an igniter main body (2); an expulsion nozzle for expelling gas; a gas tank (6) for storing fuel; a valve mechanism (8) for opening and closing a gas channel between the gas tank and the expulsion nozzle; an ignition device (15) for generating an ignition discharge voltage; and an operating member (20) for performing the ignition operation. At least one of the valve mechanism (8) and the ignition device (15) are provided so as to be movable in the direction that the operating member (20) is pressed, accompanying a pressing operation of the operating member (20). Ignition is enabled by blocking the movement of the movable member from among the valve mechanism (8) and the ignition device (15) during the pressing operation of the operating member (20).

4 Claims, 7 Drawing Sheets

IGNITOR

TECHNICAL FIELD

The present invention relates to an igniter also known as a "firing rod". Particularly, the present invention relates to an igniter comprising: an expulsion nozzle for expelling gas; a gas tank for storing fuel therein; a gas supply path for supplying gas from the gas tank to the expulsion nozzle; a valve mechanism for opening and closing the gas supply path; an ignition device for generating an ignition discharge voltage; and an operating member for performing an ignition operation.

BACKGROUND ART

Igniters having the construction described above are convenient in that they can be employed to ignite gas cooking equipment by depressing the ignition operating member. There is demand for locking mechanisms for these igniters to prevent inadvertent and accidental ignition, and igniters having various types of locking mechanisms have been proposed.

For example, U.S. Pat. No. 6,168,423 discloses an igniter having a one-piece lock member provided with an elastic plate spring portion at one end thereof, the middle portion of the lock member being pivotally supported by a main body of the igniter. In this igniter, the lock member is operated to move to an unlocked position by pressing the end opposite the plate spring into an igniter main body with, for example, a middle finger, where it does not interfere with the ignition operation of an operating member (operated by an index finger). Elastic deformation of the plate spring portion enables pivotal movement of the lock member to the unlocked position, and when the middle finger releases the lock member, the elastic return properties of the plate spring portion return the lock member to the locked position.

However, in conventional igniters such as that described above, it is necessary to employ a finger (such as the middle finger) other than the index finger, which operates the ignition operation member. Therefore, there is a problem from the viewpoint of operability. In addition, as a simple operation such as just pressing the lock member inward enables release of the lock member, there is a problem that even small children can perform the ignition operation by employing both hands. On the other hand, if the lock release operation of a lock member becomes too complex, there is a possibility that the ignition operation will become troublesome, thus rendering the igniter impractical. In addition, if the structure becomes complex, there are disadvantages from the viewpoint of cost.

Further, in the case that a lock member is provided that necessitates an on/off operation, it is likely that the locking operation of the lock member will be forgotten with the passage of time, which defeats the purpose of having provided the lock member.

DISCLOSURE OF INVENTION

The present invention has been developed in view of the circumstances described above. It is the object of the present invention to provide an igniter that is capable of preventing inadvertent ignition without providing a lock member, that is, while obviating a locking operation.

The igniter of the present invention comprises:

an igniter main body;

an expulsion nozzle for expelling gas;

a gas tank for storing fuel therein;

a gas supply path for supplying gas from the gas tank to the expulsion nozzle;

a valve mechanism for opening and closing the gas supply path;

an ignition device for generating an ignition discharge voltage; and an operating member for performing an ignition operation; wherein at least one of the valve mechanism and the ignition device is provided in the igniter so as to be movable in the direction that the operating member is pressed, accompanying a pressing operation of the operating member; and ignition is made possible by blocking the movement of the movable member, from among the valve mechanism and the ignition device, during the pressing operation of the operating member.

That is, the igniter of the present invention includes those in which only the valve mechanism is movable, those in which only the ignition device is movable, and those in which both the valve mechanism and the ignition device are movable. The construction precludes ignition if at least one of the valve mechanism and the ignition device moves accompanying a pressing operation of the operating member.

In the case that at least the valve mechanism is movably provided, it is preferable that:

the gas tank is provided in the igniter main body so as to be integrally movable with the valve mechanism; and the igniter has an opening for a rear portion of the gas tank to protrude rearward therethrough; wherein blocking of the movement of the valve mechanism is performed by blocking the protrusion of the rear portion of the gas tank through the opening.

In addition, it is preferable that:

a cover for covering the rear portion of the gas tank that protrudes from the opening is provided at the rear end of the igniter main body so as to be slidable in the front/rear direction; wherein the blocking of the protrusion of the rear portion of the gas tank is performed by the cover blocking the movement of the gas tank.

A spring for returning the valve mechanism and the operating member to their original positions may provided between the rear portion of the gas tank and the cover, as necessary.

According to the present invention, at least one of the valve mechanism and the ignition device are provided in the igniter main body so as to be movable in the direction that the operating member is pressed, accompanying a pressing operation of the operating member. The construction precludes ignition unless this movement is blocked. Therefore, inadvertent ignition can be prevented without providing a lock mechanism for the operating member, as had been done in conventional igniters of this type.

A construction may be adopted wherein the gas tank is provided so as to be integrally movable with the valve mechanism, and the blocking of the movement of the valve mechanism is accomplished by blocking the protrusion of the rear portion of the gas tank through the opening of the igniter main body. In this case, blocking the protrusion of the rear portion of the gas tank through the opening and the pressing operation of the operating member can be performed simultaneously with one hand. Superior operability is also obtained, as the need to release a lock mechanism during an ignition operation is obviated. This simultaneous operation is impossible to be performed by a small child having small hands. Therefore, accidental ignition being performed by small children can be prevented.

In addition, no On/Off lock mechanism, such as those found on conventional igniters, is provided. Therefore, there is no possibility that a user will forget to set the lock mechanism, therefore improving the safety of the igniter.

Further, the operability 6*f* the igniter can be further improved in the case that the spring for returning the valve mechanism and the operating member to their original positions is provided between the rear portion of the gas tank and the movable cover.

BEST MODE OF CARRYING OUT THE INVENTION

Embodiments of the present invention will be described hereinbelow, with reference to the drawings.

Figure 1:
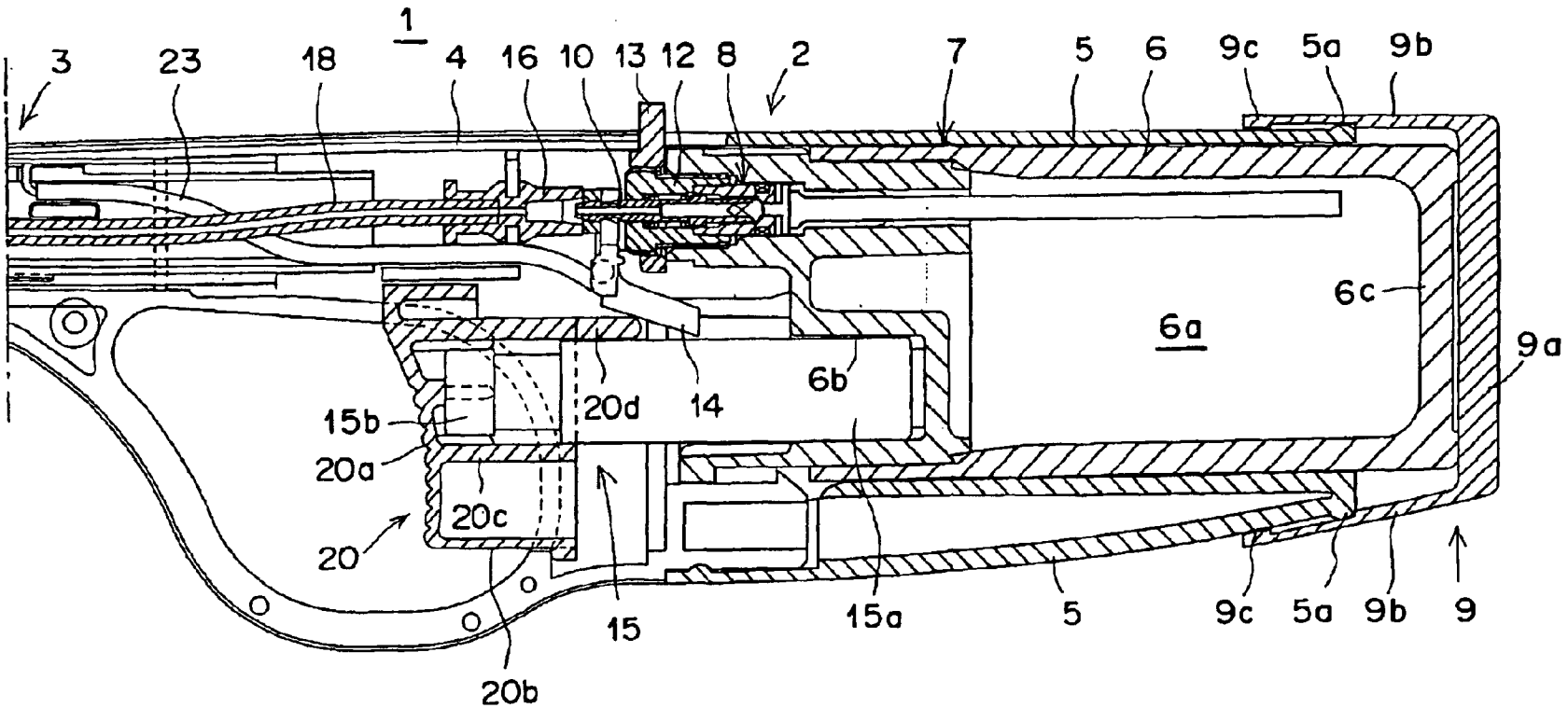
FIG. 1 is a sectional view of the main parts of an igniter according to the first embodiment of the present invention, in an initial state.
Figure 2:
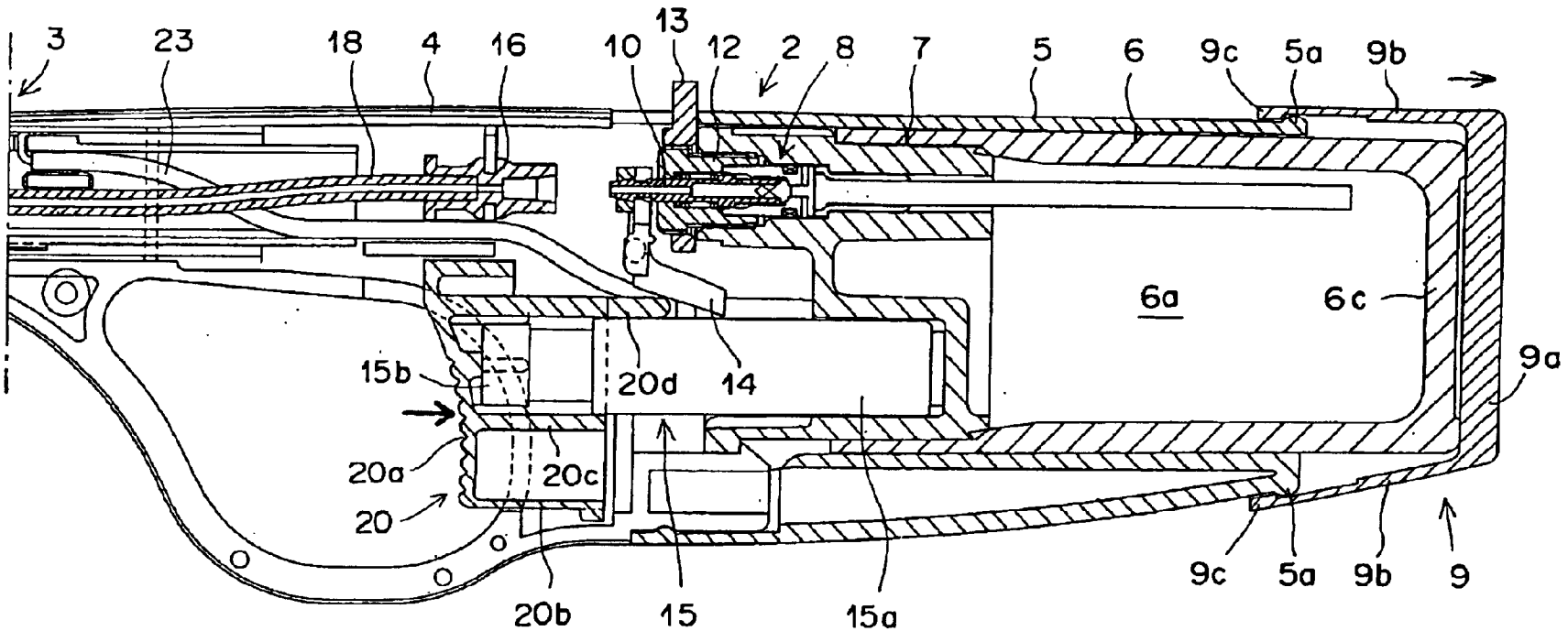
FIG. 2 is a sectional view of the main parts of the igniter of FIG. 1, in a state in which ignition is precluded.
Figure 3:
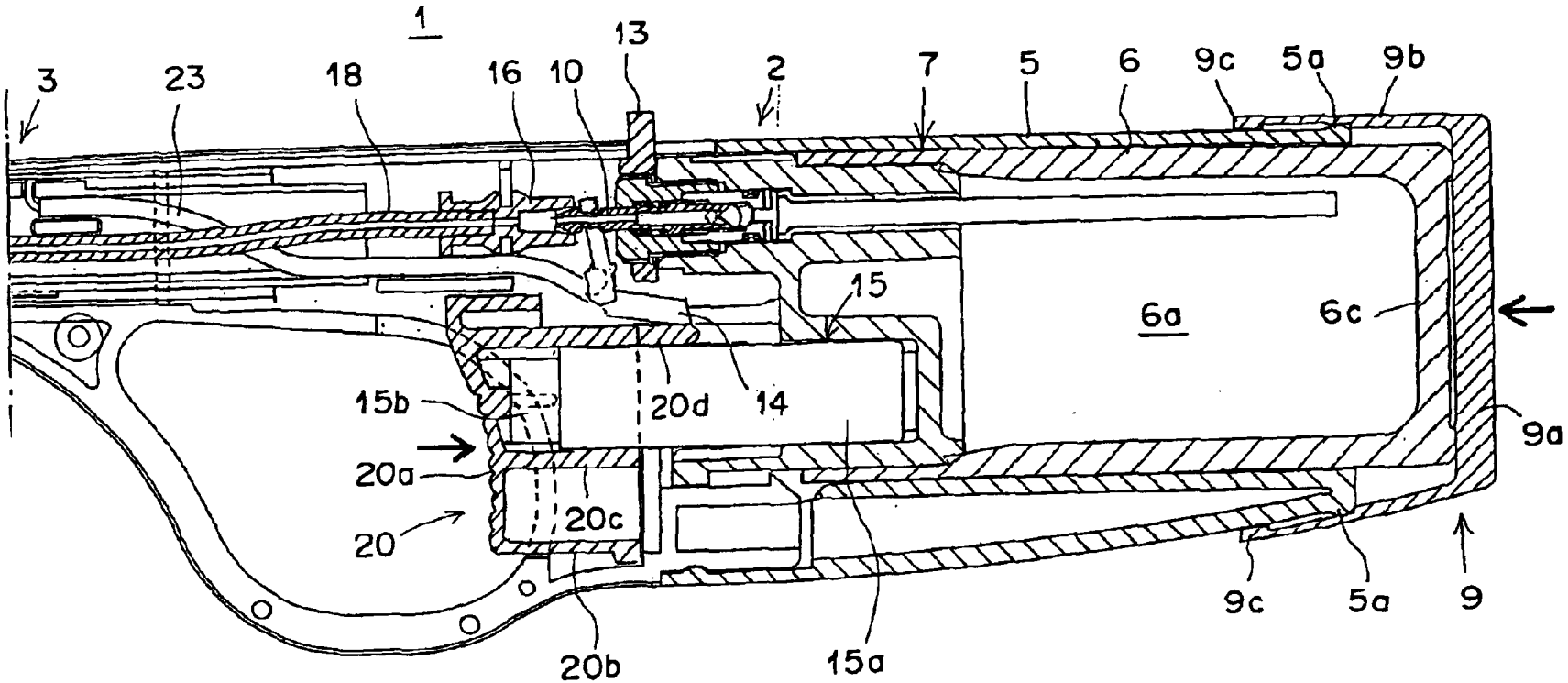
FIG. 3 is a sectional view of the main parts of the igniter of FIG. 1, during an ignition operation.

FIG. 1 through FIG. 3 show sectional views of an igniter 1 according to a first embodiment of the present invention. FIG. 1 shows the igniter 1 in an initial state. FIG. 2 shows the igniter 1 in a state in which ignition is precluded. FIG. 3 shows the igniter 1 during an ignition operation. Note that the leftward direction in the figures is designated as "front", and the rightward direction in the figures is designated as "rear".

The igniter 1 is provided with an igniter main body 2 which comprises: an intermediate case 4 which is halved by the plane of the drawing sheet; an ignition portion 3 in the form of an elongate rod, integrally provided with the intermediate case 4 and having an expulsion nozzle for expelling gas at the tip thereof (the tip is omitted from the figure); and a cylindrical rear case 5 having open front and rear ends, removably attached to the rear portion of the intermediate case 4 by spigot and socket engagement. The intermediate case 4 and the rear case 5 constitute a grip portion.

A gas supply unit 7, which is slidable in the front to rear direction, is contained within the rear case 5. The gas supply unit 7 comprises: a gas tank 6 equipped with a gas chamber 6*a* that contains high pressure gas such as butane; and a valve mechanism 8 provided at the upper portion of the front wall of the gas tank 6. The valve mechanism 8 serves to open and close a gas channel that communicates the gas chamber 6*a* with the expulsion nozzle. A nozzle member 10 that functions as a valve is provided within the gas channel. The nozzle member 10 closes the gas channel by being urged rearward by a spring provided within the valve mechanism. One end of a rotating lever 14 is engaged with the tip of the nozzle member 10. The rotating lever 14 is rotated by a pressing operation of an operating member 20, to be described later, thereby advancing the nozzle member 10. In this manner, the gas channel is opened to enable supply of gas to the expulsion nozzle (not shown) through the nozzle member 10.

A connector member 16 which is connected to a gas pipe 18 is fixedly provided in the intermediate case 4 at a position along a line extending from the tip of the nozzle member 10. The gas pipe 18 extends to the tip of the ignition portion 3, and is connected to the expulsion nozzle. Note that the amount of gas supplied, that is, the size of a flame, is adjusted by a flame adjustment knob 13 that protrudes to the exterior and is connected to an adjustment sleeve 12.

In the initial state shown in FIG. 1, a rear portion 6*c* of the gas tank 6 protrudes slightly rearward through the opening at the rear end of the rear case 5. A movable cover 9 for covering the protruding rear portion 6*c* is attached on the rear end of the rear case 5 so as to be slidable forward and rearward. The movable cover 9 comprises a flat rear wall 9*a* that contacts the rear end of the gas tank 6; and a cylindrical peripheral wall 9*b* which is elastically engaged with the outer peripheral surface of the rear case 5. Disengagement of the movable cover 9 from the rear case 5 in a normal state is prevented by annular ridges 9*c* and 5*a* being formed at the front end of the inner peripheral surface of the peripheral wall 9*b* and the rear end the outer peripheral surface of the rear case 5, respectively. The movable cover 9 is attached on the rear case 5 so that it is movable between a front position, at which it contacts the rear end of the gas tank 6 in the initial state shown in FIG. 1, and a rear position, to which it has been pushed by the rear portion 6*c* of the gas tank 6, shown in FIG. 2.

A piezoelectric unit 15 is provided beneath the valve mechanism 8. The piezoelectric unit 15 is an example of an ignition device that generates a discharge voltage for ignition. The piezoelectric unit 15 comprises an elongate cylindrical piezoelectric unit main body 15*a* having a spring (not shown) therein; and a slide portion 15*b* which is urged to protrude forward by the spring. A recess 6*b*, for housing the rear portion of the piezoelectric unit main body 15*a*, is formed in the front wall of the gas tank 6 beneath the valve mechanism 8. The piezoelectric unit main body 15*a* is fitted within the recess 6*b* by being inserted thereinto from the front. The rear end surface of the piezoelectric unit main body 15*a* abuts a vertical rear wall of the recess 6*b*. This abutment causes the gas supply unit 7 to move rearward integrally with the piezoelectric unit main body 15*a*, and causes the piezoelectric unit main body 15*a* to move forward integrally with the gas supply unit 7.

A lead wire 23 which is connected to a first pole of the piezoelectric unit is connected to a discharge electrode (not shown). A second pole of the piezoelectric unit 15 is connected to the expulsion nozzle at the tip of the ignition portion 3, via a path not shown in the figures.

An ignition operation member 20 that slides in the front to rear direction is provided in the intermediate case 4, which constitutes a grip portion along with the rear case 5. The operating member 20 comprises: a box-like base portion 20*b* which is slidably supported within the intermediate case 4; and an operating portion 20*a* provided at the front end of the box-like base portion 20*b*. The slide portion 15*b* of the piezoelectric unit 15 is engaged from behind to the upper portion of the box-like base portion 20*b*, above an intermediate wall 20*c* provided therein. In addition, a leg portion 20*d* that extends rearward is connected to the end of the box-like base portion 20*b*. The leg portion 20*d* engages with an end of the rotating lever 14 during an ignition operation of the operation member 20, and functions to rotate the rotating lever 14.

The rotating lever 14 is substantially L-shaped, and is supported so as to be rotatable about a pivot at its midpoint. In the case that the rotating lever 14 is rotated counterclockwise by the leg portion 20*d* of the operating member 20, the rotating lever 14 pulls the nozzle member 10 forward to open the gas channel. At the same time, the nozzle member 10 is connected to the connector member 16, thereby gas is supplied to the gas pipe 18 via the connector member 16.

Next, the operation of the igniter 1 constructed in the above manner will be described.

First, the grip portion is held by one hand and the operating member 20 is pressed by a finger from the initial state shown in FIG. 1. At this time, no force is applied to the rear wall 9*a* of the movable cover 9 to press it forward. That is, the gas supply unit 7 and the piezoelectric unit 15 are allowed to move rearward in this state. In this case, the force applied to the slide portion 15*b* of the piezoelectric unit 15 by the operating member 20 does not compress the spring (in this case, the spring acts as a rigid body), but is transferred directly to the piezoelectric unit main body 15*a*. Thereby, the entire ignition device 15 is pressed rearward along with the gas supply unit 7 by the operating member 20. The igniter 1 assumes the state shown in FIG. 2, wherein the rear portion 6*c* of the gas tank 6 protrudes further from the rear end of the rear case 5. Therefore, regardless of the fact that a pressing operation of the operating member 20 has been performed, a discharge voltage generation operation is not performed by the piezoelectric unit 15.

As clearly shown in FIG. 2, the valve mechanism 8 moves rearward along with the nozzle member 10, accompanying the rearward motion of the gas supply unit 7 caused by the pressing operation of the operating member 20. Therefore, the relative positions of the operating member 20 and the nozzle member 10 do not change from the state shown in FIG. 1. The rotating lever 14 is not rotated, and accordingly, the gas channel of the valve mechanism 8 remains closed. The gas supply unit 7, the piezoelectric unit 15, and the operating member 20 are returned to the initial state shown in FIG. 1 by releasing the operating member 20 while pressing the rear wall 9*a* of the movable cover forward.

On the other hand, the grip portion may be held while the rear wall 9*a* of the movable cover 9 is engaged with the base portion of a thumb. That is, rearward motion of the gas supply unit 7 and the piezoelectric unit main body 15*a* are blocked. In the case that a pressing operation of the operating member 20 is performed in this state, the leg portion 20*d* of the operating member 20 engages the end of the rotating lever 14 to rotate the rotating lever 14 counterclockwise, as shown in FIG. 3. Thereby, the nozzle member 10 of the valve mechanism 8 is pulled forward to open the gas channel of the valve mechanism 8. Gas is supplied to the gas pipe 18 via the connector member 16, and gas is expelled from the expulsion nozzle at the tip of the ignition portion 3.

At the same time, the slide portion 15*b* of the piezoelectric unit 15 enters the piezoelectric unit main body 15*a* while compressing the spring housed therein. Thereby, a discharge voltage is generated, ignition sparks are generated at the expulsion nozzle, and a gas flame is generated.

As is clear from the description above, in the present embodiment, the gas tank 6; the gas supply unit 7, which has the valve mechanism 8 for opening and closing the gas channel from the gas tank; and the piezoelectric unit 15, comprising the piezoelectric unit main body 15*a* and a slide portion 15*b*, which is urged forward by the spring within the piezoelectric unit main body 15*a* are provided in the igniter main body 2 so as to be movable in the direction that the operating member 20 is pressed, accompanying the pressing operation of the operating member 20. Therefore, ignition is precluded by the piezoelectric unit main body 15*a* and the gas supply unit 7 moving rearward accompanying the pressing operation of the operating member 20, unless the rear wall 9*a* of the movable cover 9 is engaged to block movement thereof.

Ignition is made possible by pressing the operating member 20 while holding the grip portion and pressing the rear wall 9*a* of the movable cover 9 to block the movement of the gas supply unit 7 within the igniter main body 2. This operation simultaneously enables the opening operation of the valve mechanism 8 and the entrance of the slide unit 15*b* into the piezoelectric unit main body 15*a*.

In the present embodiment, the blocking of the movement of the gas supply unit 7 and the piezoelectric unit main body 15*a* is performed by blocking the movement of the movable cover 9. This construction allows a user to block the movement of the gas supply unit 7 and the piezoelectric unit main body 15*a* while performing the pressing operation of the operating member 20 using only one hand. Therefore, superior operability is exhibited by the igniter 1.

Simultaneous pressing of the rear wall 9*a* of the movable cover 9 and of the operating member 20 with one hand is impossible to be performed by a small child having small hands. Therefore, accidental ignition by small children can be prevented.

As the igniter 1 is not equipped with a conventional On/Off type lock mechanism, the trouble of releasing the lock when performing the ignition operation is obviated. In addition, there is no possibility that setting of the lock mechanism will be forgotten. Note that a battery may be employed instead of the piezoelectric unit 15, as the ignition device.

Figure 4:
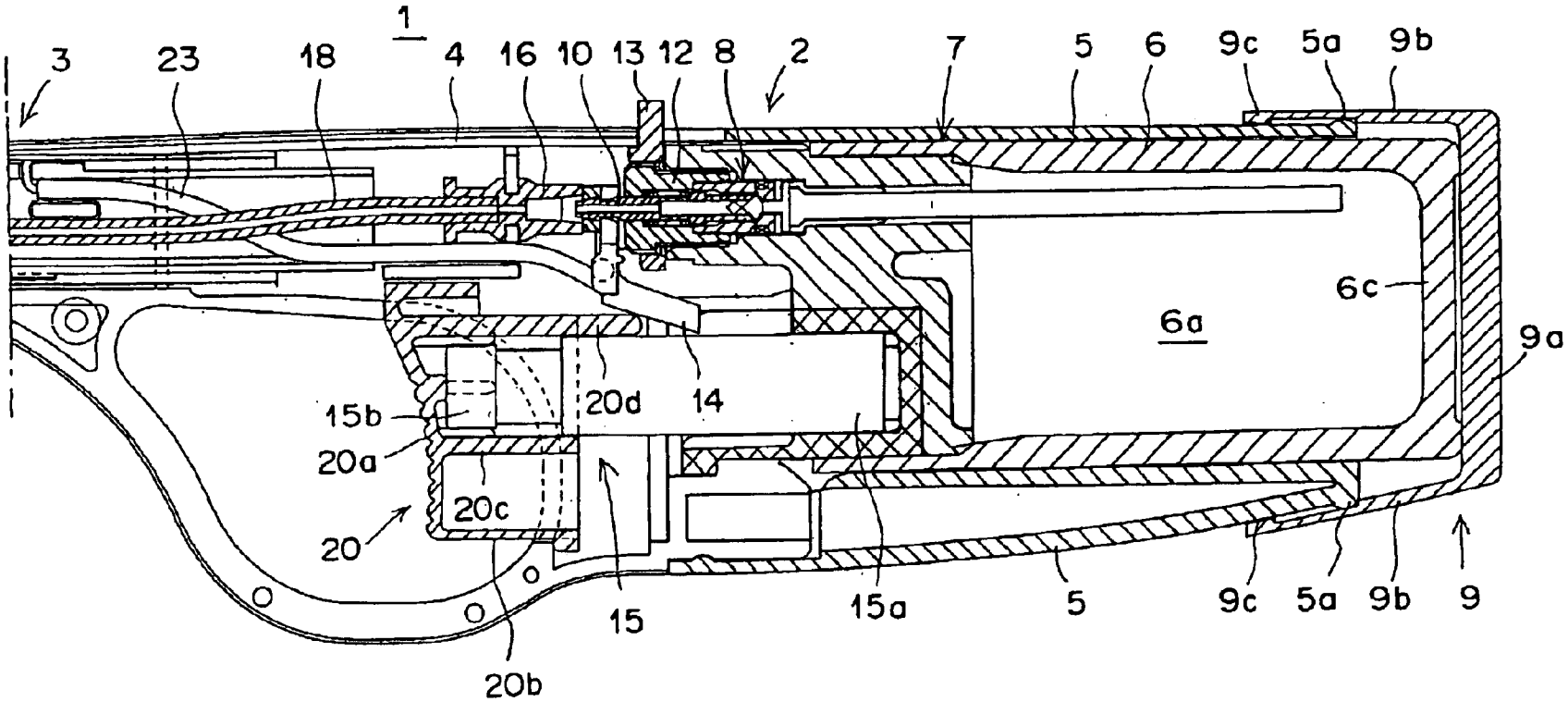
FIG. 4 is a sectional view of the main parts of an igniter according to the second embodiment of the present invention, in an initial state.
Figure 5:
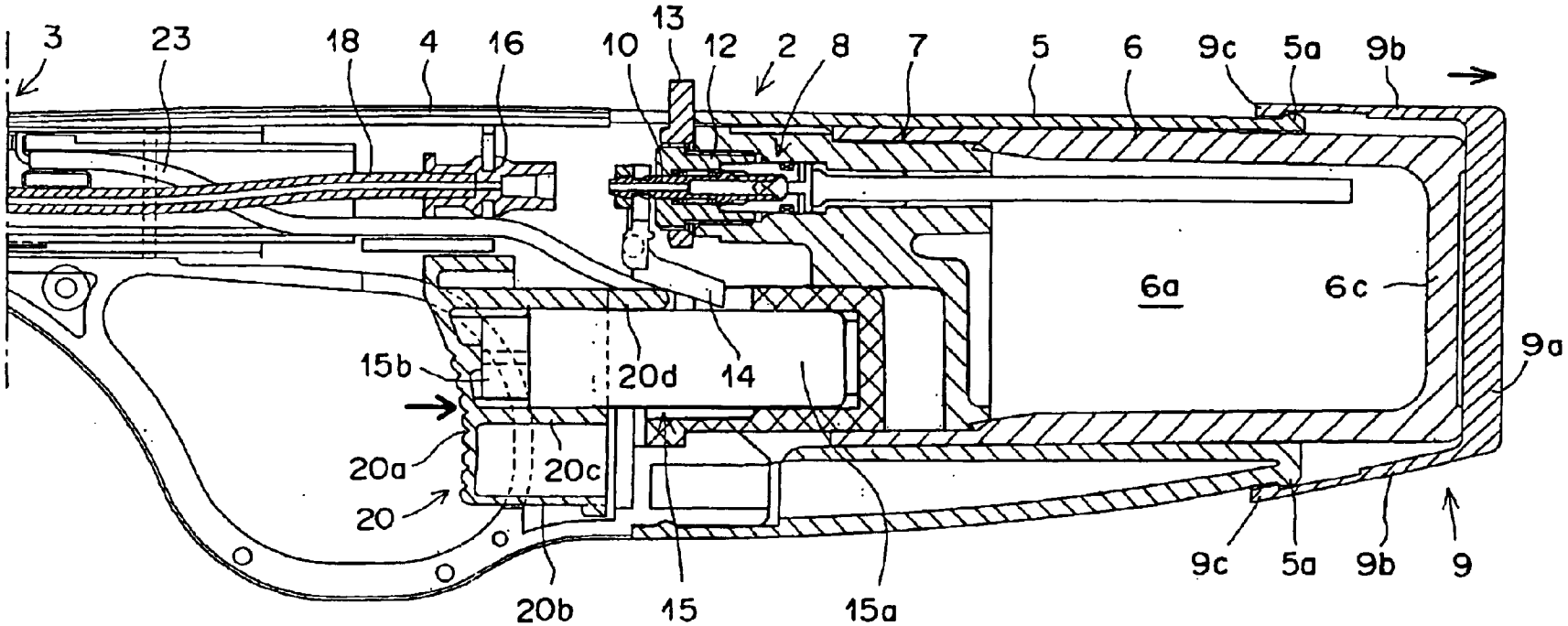
FIG. 5 is a sectional view of the main parts of the igniter of FIG. 4, in a state in which ignition is precluded.

Next, an igniter according to the second embodiment of the present invention will be described with reference to FIG. 4 and FIG. 5. FIG. 4 is a sectional view of the main parts of the igniter according to the second embodiment in an initial state, corresponding to FIG. 1. FIG. 5 is a sectional view of the main parts of the igniter according to the second embodiment in a state that ignition is precluded, corresponding to FIG. 2. Note that parts shown in FIG. 4 and FIG. 5 that correspond to the same parts shown in FIG. 1 and FIG. 2 are denoted with the same reference numerals, and redundant descriptions are omitted.

In the first embodiment described above, both the gas supply unit, comprising the gas tank 6 and the valve mechanism 8, and the piezoelectric unit 15 were movably provided in the igniter main body 2. However, in the igniter according to the second embodiment, the piezoelectric unit 15 is fixed to the igniter main body 2. Only the gas supply unit 7 moves rearward accompanying a pressing operation of the operating member 20, so that an opening operation of the nozzle member 10 is not performed, as shown in FIG. 5.

Accordingly, ignition sparks are generated when the operating member 20 is pressed. However, as gas is not supplied to the expulsion nozzle, accidental ignition by small children can be prevented in the same manner as in the first embodiment described above.

Note that as a modification of the second embodiment, a construction may be adopted wherein the gas supply unit 7 is fixed in the igniter main body 2. In an igniter having such a construction, ignition is precluded by only the piezoelectric unit 15 moving rearward accompanying a pressing operation of the operating member 20. In this case, it is preferable that a mechanism, for stopping the supply of gas to the expulsion nozzle, be added.

Figure 6:
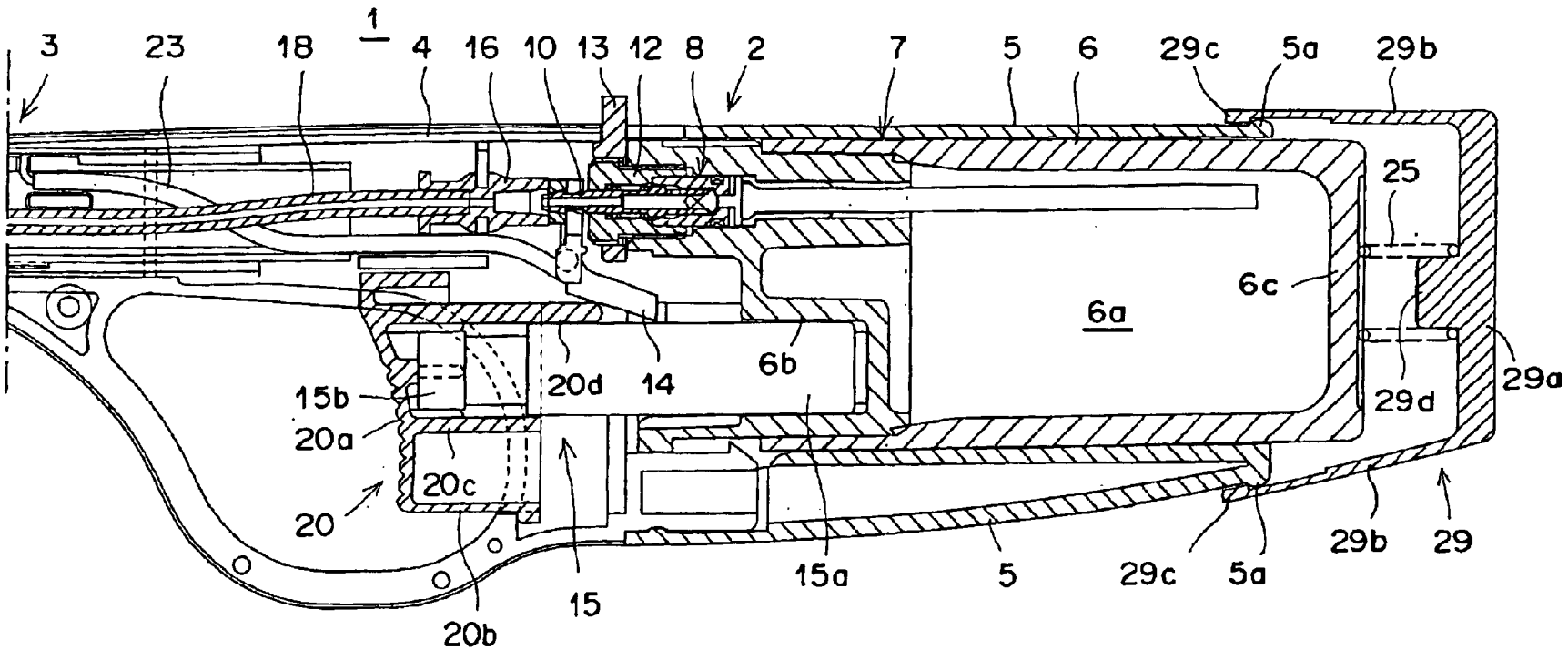
FIG. 6 is a sectional view of the main parts of an igniter according to the third embodiment of the present invention, in an initial state.
Figure 7:
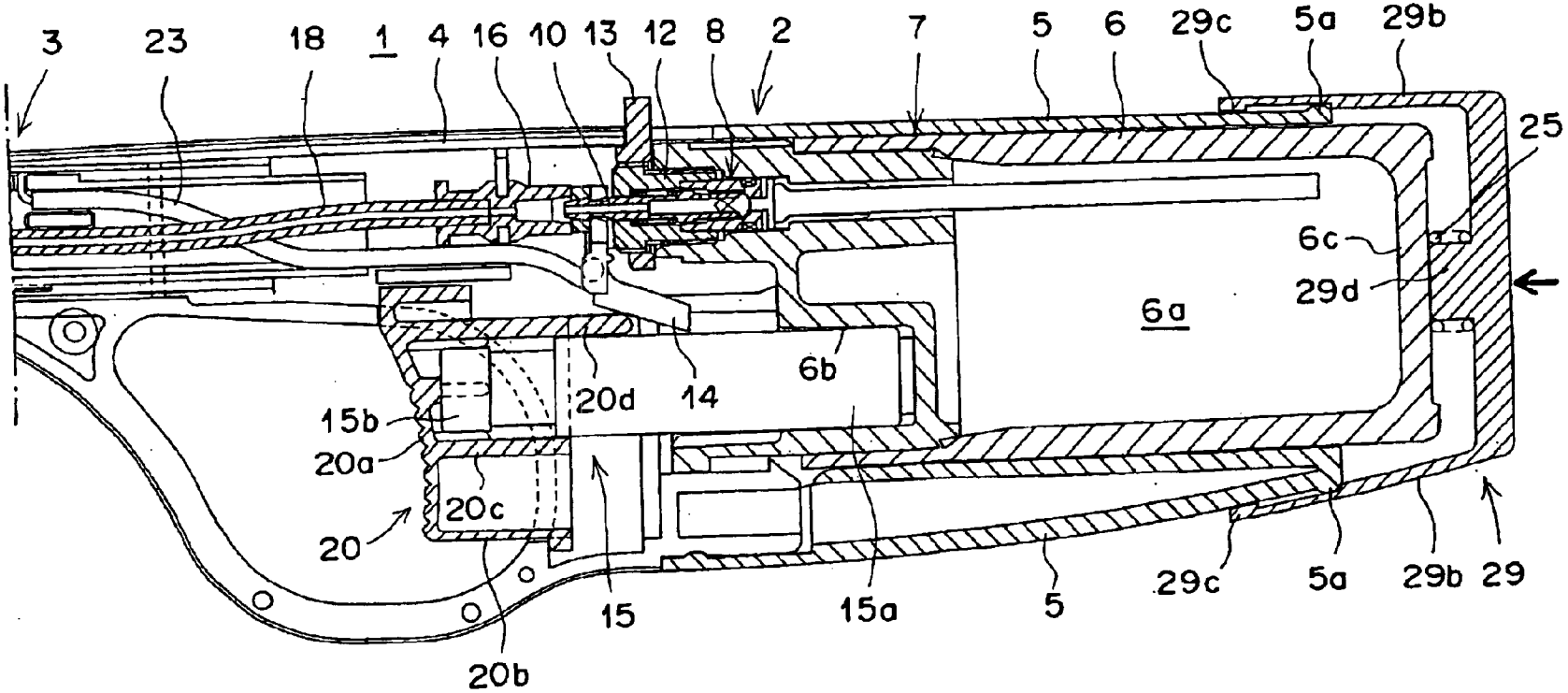
FIG. 7 is a sectional view of the main parts of the igniter of FIG. 6, in a state in which ignition is possible.

Next, an igniter according to the third embodiment of the present invention will be described with reference to FIG. 6 and FIG. 7. FIG. 6 is a sectional view of the igniter according to the third embodiment in an initial state. FIG. 7 is a sectional view of the igniter according to the third embodiment in a state in which ignition is possible. The igniter of the third embodiment is the igniter of the first embodiment, shown in FIG. 1 through FIG. 3, with an automatic return mechanism added thereto.

In the construction shown in FIG. 6, a cup-shaped movable cover 29 for covering the rear portion 6*c* of the gas tank 6 is provided at the rear end of the rear case 5 so that it is slidable forward and rearward. A forwardly protruding protrusion 29*d* is provided at the center of the front surface of a rear wall 29*a* of the movable cover 29. A coil spring 25 is provided between the rear wall 29*a* of the movable cover 29 and the rear end surface of the gas tank 6. The coil spring 25 is supported at one end thereof by the protrusion 29*d*. In this case, the length of a peripheral wall 29*b* of the movable cover 29 is formed to be longer in the front to rear direction than the movable cover 9 shown in FIG. 1, by an amount equal to the distance that the protrusion 29*d* protrudes.

Annular ridges 29*c* and 5*a* are formed at the front end of the inner peripheral surface of the peripheral wall 29*b* and the rear end the outer peripheral surface of the rear case 5, respectively. The movable cover 29 is held at a rearward position, at which the annular ridges 29*c* and 5*a* engage each other, by the urging force of the coil spring 25.

The urging force of the coil spring 25 is set to be weaker than that of the spring provided within the piezoelectric unit main body 15*a*. Accordingly, the gas supply unit 7 and the piezoelectric unit 15 are capable of moving rearward until the rear end portion 6*c* of the gas tank 6 abuts the front end surface of the protrusion 29*d* of the movable cover 29, by a pressing operation of the operating member 20 from this state. That is, rearward movement is possible to the same position shown in FIG. 2, by compressing the coil spring 25, thereby precluding ignition. When the operating member 20 is released, the gas supply unit 7, the piezoelectric unit 15 and the operating member 20 are automatically returned to their initial positions by the urging force of the coil spring 25.

On the other hand, the rear wall 29*a* of the movable cover 29 may be pressed forward during the pressing operation of the operating member 20. If the operating member 20 is pressed while rearward movement of the gas supply unit and the piezoelectric unit 15 are blocked, by the protrusion 29*d* of the movable cover 29 abutting the rear end surface of the gas tank 6 as shown in FIG. 7, the ignition operation is enabled in the same manner as that shown in FIG. 3.

According to the present embodiment, the coil spring 25 is provided between the rear wall 29*a* of the movable cover 29 and the rear end surface of the gas tank 6. Therefore, the gas supply unit 7 and the piezoelectric unit 15 are enabled to be automatically returned to their initial positions after being moved rearward. The operability of the igniter according to the third embodiment is improved from that of the igniter according to the first embodiment in this point. Note that although a coil spring 25 is employed in the third embodiment, the spring is not limited to this. It is possible to employ springs having alternate structures. In addition, the rear walls 9*a* and 29*a* of the movable covers 9 and 29 are pressed to block the rearward movement of the gas supply unit 7 and the piezoelectric unit main body 15*a* in the embodiments described above. However, the present invention is not limited to this construction, and it goes without saying that other engagement means are capable of achieving the objective of the present invention.

What is claimed is:

1. An igniter comprising:

an igniter main body;

an expulsion nozzle for expelling gas;

a gas tank for storing fuel therein;

a gas supply path for supplying gas from the gas tank to the expulsion nozzle;

a valve mechanism for opening and closing the gas supply path;

an ignition device for generating an ignition discharge voltage; and an operating member for performing an ignition operation; wherein at least one of the valve mechanism and the ignition device is provided in the igniter so as to be movable in the direction that the operating member is pressed, accompanying a pressing operation of the operating member; and ignition is made possible by blocking the movement of the movable member, from among the valve mechanism and the ignition device, during the pressing operation of the operating member.

2. An igniter as defined in claim 1, wherein the gas tank is provided in the igniter main body so as to be integrally movable with the valve mechanism; and the igniter has an opening for a rear portion of the gas tank to protrude rearward therethrough; wherein blocking of the movement of the valve mechanism is performed by blocking the protrusion of the rear portion of the gas tank through the opening.

3. An igniter as defined in claim 2, wherein a cover for covering the rear portion of the gas tank that protrudes from the opening is provided at the rear end of the igniter main body so as to be slidable in the front/rear direction; wherein the blocking of the protrusion of the rear portion of the gas tank is performed by the cover blocking the movement of the gas tank.

4. An igniter as defined in claim 3, wherein a spring for returning the valve mechanism and the operating member to their original positions is provided between the rear portion of the gas tank and the cover.

* * * * *